299-13
8/16/83 XR 4,398,769

United States Patent [19]

Jacoby

[11] 4,398,769

[45] Aug. 16, 1983

[54] METHOD FOR FRAGMENTING UNDERGROUND FORMATIONS BY HYDRAULIC PRESSURE

[75] Inventor: Charles H. Jacoby, Tempe, Ariz.

[73] Assignee: Occidental Research Corporation, Irvine, Calif.

[21] Appl. No.: 206,088

[22] Filed: Nov. 12, 1980

[51] Int. Cl.[3] ..... E21B 43/28

[52] U.S. Cl. ..... 299/4; 166/271; 166/299; 299/13

[58] Field of Search ..... 299/4, 5, 13; 166/271, 166/299, 308, 249; 175/4.6

[56] References Cited

U.S. PATENT DOCUMENTS

| | | | |
|---|---|---|---|
| Re. 21,356 | 2/1940 | Pitzer | 166/21 |
| 2,676,662 | 4/1954 | Ritzmann | 166/21 |
| 2,850,270 | 3/1956 | Hanson | 262/3 |
| 2,915,122 | 12/1959 | Hulse | 166/42 |
| 3,048,226 | 8/1962 | Smith | 166/42 |
| 3,070,010 | 12/1962 | Robinson | 175/4.6 X |
| 3,086,760 | 4/1963 | Bays | 299/5 X |
| 3,215,074 | 11/1965 | Robinson et al. | 175/4.6 X |
| 3,387,888 | 6/1968 | Shock et al. | 299/4 |
| 3,455,383 | 7/1969 | Prats et al. | 299/4 |
| 3,890,007 | 6/1975 | Heinen et al. | 299/4 |
| 3,933,205 | 1/1976 | Kiel | 166/308 |
| 3,964,792 | 6/1976 | Archibald | 299/13 |
| 3,964,792 | 6/1976 | Archibald | 299/13 |
| 4,018,293 | 4/1977 | Keller | 175/4.5 |
| 4,039,030 | 8/1977 | Godfrey et al. | 166/308 X |
| 4,163,580 | 8/1979 | Pearson et al. | 166/249 X |
| 4,265,311 | 5/1981 | Ely | 166/271 |

OTHER PUBLICATIONS

Pages 50 through 58 of *Hydraulic Fracturing* by G. C. Howard and C. R. Fast, Society of Petroleum Engineers of AIME (1970).

*Primary Examiner*—Ernest R. Purser
*Attorney, Agent, or Firm*—Christie, Parker & Hale

[57] ABSTRACT

An in situ leaching or solution mining process is conducted in a subterranean cavity in communication with a well bore. The subterranean cavity is gradually enlarged by inducing spallation of formation particles and/or collapse of the roof into the cavity by repeatedly cycling the hydraulic pressure in the subterranean cavity. The hydraulic pressure is preferably increased during a period of at least about two hours. The hydraulic pressure can be gradually decreased during a period of at least about two hours or can be suddenly decreased. Rapid pressure pulses can be applied to liquid in the subterranean cavity by detonation of shaped charges of explosive with the axis of force of the charge being directed along the axis of the well.

48 Claims, 3 Drawing Figures

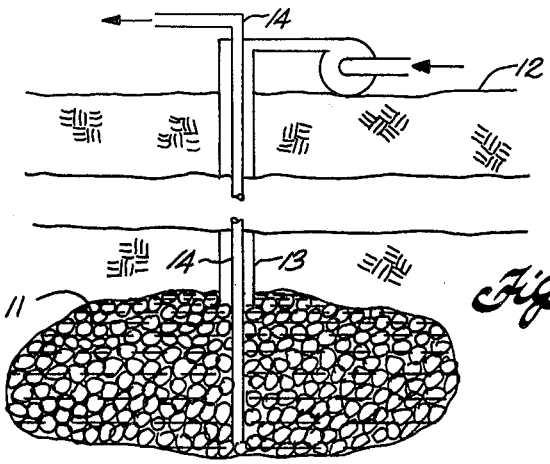
Fig. 1
Fig. 2
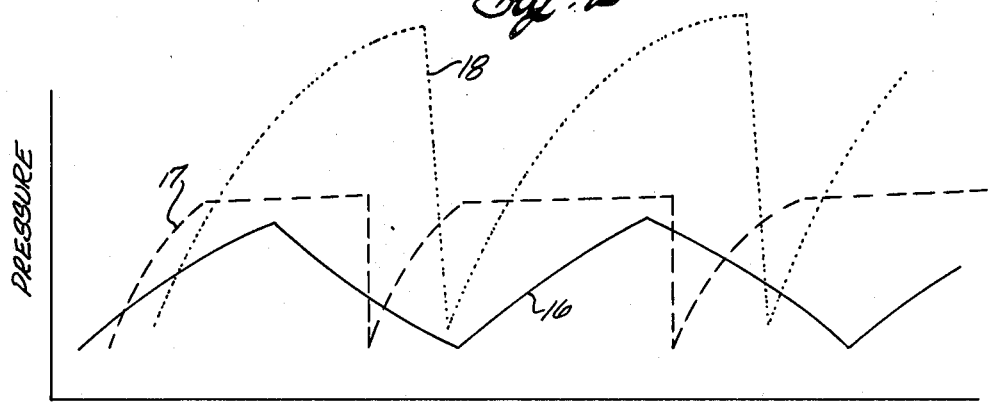
Fig. 3
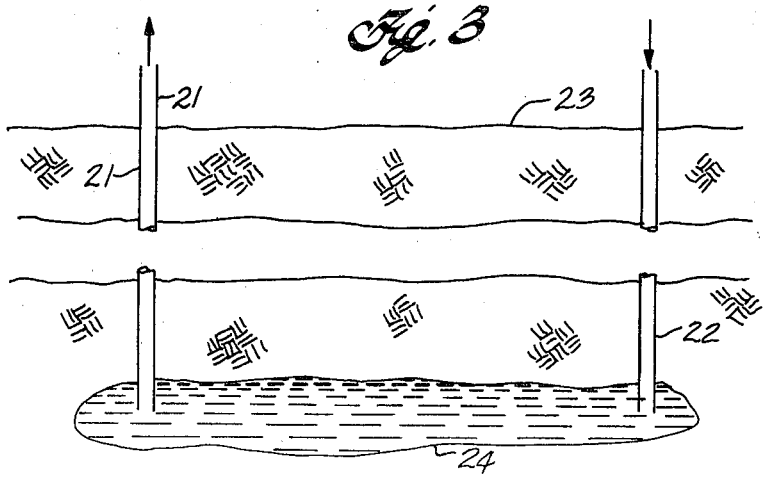

METHOD FOR FRAGMENTING UNDERGROUND FORMATIONS BY HYDRAULIC PRESSURE

FIELD OF THE INVENTION

This invention relates to enlarging a subterranean cavity for solution mining or in situ leaching by application of varying hydraulic pressure.

BACKGROUND

In some circumstances it can be desirable to extract mineral values from an underground formation by dissolving the valuable constituents in situ. Insoluble gange minerals can be left in the underground voids or solution cavities in the formation, thereby minimizing disposal problems which follow above ground processing. Such a technique can be suitable for minerals that are essentially water soluble, such as halite or trona, minerals that can be dissolved in alkaline solutions such as nahcolite, or acid soluble minerals such as oxidized copper ore. The soluble minerals can be in massive bodies readily dissolved by circulating leach liquid or can be dispersed in an insoluble matrix, either as veins, stringers, beds, or laminations and pockets, or as phenocrysts of sought after values. Fragmenting can be important for exposing dispersed minerals to leach solutions.

Leaching or solution mining can be conducted on the fragmented material present in stopes following conventional mining operations. Alternatively, an ore to be leached can be explosively expanded following mining operations so as to be sufficiently permeable to permit passage of leaching liquids. These techniques involve underground mining with its associated costs and hazards.

It can be preferable to gain access to the mineral by way of bore holes or wells from the ground surface since no mining operations are required. In such a technique the leaching solution contacts unfragmented formation which can have low permeability and consequently low rates of leaching. It can therefore be desirable to induce and enhance permeability by fragmenting the subterranean formation associated with the cavity and/or mineralized mass, thereby increasing the rate of dissolution and enhancing the rate and effectiveness of leaching. Void space and exposed surface are needed for permeability for better leaching than a bore hole furnishes.

It is therefore desirable to create a cavity adjacent a well bore or interconnecting a plurality of well bores and conduct leaching operations in and around such a cavity. A substantial quantity of subterranean formation can be contacted by leaching solution in such a situation.

An initial cavity for leaching or solution mining can be formed by a variety of techniques. When a plurality of wells are provided in the subterranean formation the cavity can be initiated by hydraulic fracturing, that is, by increasing hydraulic pressure in one or more of such wells until a fracture is induced through the subterranean formation, providing communication with one or more additional wells. The locus of such a hydraulic fracture is sometimes guided by initially "notching" formation adjacent the bore of a well. Notching can be conducted by several methods; for example, a shaped charge of explosive, bullets, or the like, can be used for perforating the well bore and providing a locus for initiation of a fracture. Alternatively, a horizontal slot in the wall of the well bore can be cut by an underreamer.

An initial cavity can be formed by leaching action which can be localized by introducing a hydrocarbon "cap" over the leaching solution. Alternatively, such leaching can be directionally guided with jets of the leaching solution. Such an arrangement can be employed for interconnecting wells in an array of wells or for initiating a cavity adjacent a single well.

An initial cavity can be formed by explosive "springing" or by using a high pressure jet for eroding formation adjacent a well. Springing is a technique for enlarging the bottom of a drill hole by exploding a small explosive charge in it. A number of charges of increasing size can be detonated for gradually increasing the hole size to a desired extent. These techniques have a tendency to create an undesirable vertical dimension of the initial cavity and expose a large surface area.

Connections can also be made between wells by "whipstocking" or angle drilling a new well into the bore of an existing well or a cavity surrounding an old well. A combination of such techniques can be employed for initiating and/or enlarging void space in the subterranean formation for in situ leaching.

It is desirable to continually enlarge the cavity for exposing additional mineral for solution mining or in situ leaching. Leaching alone can gradually enlarge the cavity. The cavity can enlarge by spalling or sloughing of formation from the walls and roof of the cavity into the cavity and by collapse of overlying formation from the roof into the cavity. The walls and roof can be weakened by continual leaching action for enlarging the cavity. Particles of formation sloughing into the cavity can remain in place and the cavity can contain a substantial volume of such permeable rubble which continues to be subjected to leaching action. Some of the smaller insoluble particles can be withdrawn in leach solution withdrawn from the cavity. Such withdrawal can augment solution of the soluble minerals for increasing volume in the cavity for further fragmentation and exposure of minerals to leaching.

Enlargement of such a cavity and exposure of new surface for leaving solely by leaching action and lithostatic forces can be slower than desired and the rate of recovery of mineral values from the formation can thereby be limited. It is desirable to provide techniques for enlarging such a subterranean cavity at a rate faster than accomplished by leaching alone. It is desirable to increase surface area exposed to leaching action and enhance permeability of the formation.

SUMMARY

Thus, in practice of this invention according to a presently preferred embodiment, there is provided a method for enlarging a subterranean solution mining cavity, inducing additional artificial permeability and exposing surfaces of new sought after mineral values. Such a cavity having a substantially unsupported roof in a subterranean formation is subjected to repeated cyclic hydraulic pressure in the cavity between a minimum pressure of about the hydraulic head between the cavity and the ground surface or less, and a maximum pressure sufficient to lift the roof of the cavity but insufficient to lift overburden above the top of the stress arch which forms over the cavity. Hydraulic pressure is increased during a period of at least about two hours and then the pressure is decreased. The pressure can either be reduced gradually for repeatedly flexing the roof of the cavity or can be suddenly reduced. Such cycling of hydraulic pressure can cause spalling and fragmentation of subterranean formation and enlargement of the subterranean cavity. Alternatively, rapid pressure pulses can be applied in the subterranean cavity by placing a shaped charge of explosive in the well bore communicating with the subterranean cavity. The axis of the force of the shaped charge is preferably aligned with the well bore so that detonation of the explosive causes minimal damage to the wall of the bore hole. Detonation of a series of such shaped charges applies high pressure pulses to the underground formation by way of the liquid in the cavity and can promote spalling.

DRAWINGS

These and other features and advantages of the present invention will be appreciated as the same becomes better understood by reference to the following detailed description when considered in connection with the accompanying drawings wherein:

FIG. 1 is a semi-schematic vertical cross section of a subterranean cavity as employed for practice of this invention;

FIG. 2 is a generalized graph of pressure in such a cavity as a function of time; and FIG. 3 is a semi-schematic vertical cross-section of another cavity for practice of this invention.

DESCRIPTION

FIG. 1 illustrates a subterranean cavity 11 below the ground surface 12. A bore hole or well communicates between the ground surface and the cavity and is lined with a casing 13 which is in fluid communication with an upper portion of the cavity. Inside the casing 13 is a pipe 14 extending from above the ground surface to near the bottom of the subterranean cavity 11. A leach liquid substantially fills the cavity and insoluble rubble of formation particles can remain in the cavity.

Although illustrated as a subterranean "room" containing a rubble of fragmented formation particles, it should be recognized that the cavity in the subterranean formation can take a variety of forms. It can, for example, be in the form of such a room. It can also be in the form of a network of crevices extending through the formation. The cavity is characterized by a substantial inability to support the load of overburden above the cavity due to the presence of void spaces between solid particles in the cavity.

The subterranean cavity is employed for extracting mineral values by a liquid comprising a solvent which is introduced into the cavity through the casing 13. Mineral values are dissolved from the underground formation in and surrounding the cavity. This forms a pregnant solution which tends to migrate towards the bottom of the cavity since it is more dense than the solvent liquid. Such pregnant solution is withdrawn from the cavity by way of the inner pipe 14. The cavity remains substantially filled with liquid and fresh solvent liquid is continually introduced near the roof and pregnant solution is continually withdrawn from near the bottom. Alternatively, solvent liquid can be introduced near the bottom and pregnant solution withdrawn near the roof.

In an exemplary embodiment the subterranean formation comprises a copper ore containing oxidized copper and various copper and copper-iron sulfides. The solvent liquid comprises an aqueous sulfuric acid solution with ferric ion for promoting oxidation of the copper minerals. The solvent liquid can also contain some ferrous ion and residual copper from the processes used to strip copper from the pregnant solution. The pregnant solution is enriched in copper and also contains dissolved iron. Many other examples of minerals and solvent liquids suitable for in situ leaching will be apparent.

Such a cavity can be initiated by drilling a bore hole from the ground surface to a stratum to be leached in situ. A suitable casing is cemented into some or all of the bore hole. The bottom of the bore hole or well is enlarged by fracturing, underreaming, blasting, water jetting, and/or dissolution of surrounding formation. The initial cavity so formed is substantially filled with liquid which applies a hydraulic pressure on formation surrounding the cavity. The initial cavity can then be enlarged during leaching operations as provided in practice of this invention.

The cavity that forms can contain particles of fragmented formation as a permeable mass in the cavity. Such rubble is formed of insoluble constituents of the underground formation. At least a portion of the particles can also be removed from the cavity entrained in the pregnant solution as it is withdrawn. Such a fragmented mass of particles in the cavity does not effectively fill the cavity so that the roof is substantially unsupported by the fragmented mass.

Before such a cavity is formed, the weight of overburden above the elevation of the cavity is distributed substantially uniformly in a horizontal plane at the elevation of the formation to be leached. When the cavity is formed, direct support for the overburden above the cavity is removed. That load must shift to adjacent unfragmented formation. A pressure arch or stress arch develops above the cavity, redistributing the load over the cavity and concentrating stresses laterally from the cavity, largely adjacent the peripheral edges of the cavity. The transfer of stresses from over the cavity forms a stress arch or pressure arch where the formation is in compression. Beneath this stress arch over the cavity the formation is in tension and flexes downwardly, forming sag crevices under the arch and ceasing to support the overburden. This region between the arch and the roof of the cavity can remain essentially intact for long periods. Thus, the roof of the cavity may be subject to leaching action by the solvent liquid essentially only at the roof surface. Spalling of material from the roof as leaching progresses exposes new surface but the rate of enlargement of the cavity can be appreciably slower than desired.

Liquid in the cavity can help relieve some of the roof stresses in formation above the cavity and reduce their concentration around the cavity. This liquid is at a pressure in the order of the hydrostatic head of liquid between the elevation of the cavity and the ground surface. Such liquid does not support the overburden load in the same manner as the original intact formation and does not prevent the distribution of overburden load by a pressure arch.

As a first approximation the stress concentrations due to redistribution of stress by a stress arch are reduced by a factor equal to the hydrostatic head of the column of liquid between the cavity and the surface.

It might be noted that the hydraulic or "hydrostatic" head between the ground surface and a subterranean cavity can differ at various times or operating conditions. When no fluid is flowing, the pressure is equivalent to the static head of the column of liquid in the well, a function of the height of the column and the density of the liquid. When liquid is flowing pressure can be increased due to friction in the well and friction as liquid flows through permeable portions of the formation. When solvent is forced into a well for causing pregnant liquid to flow from a well, pressure can also increase due to the difference in density between the two liquids. Pressure can be decreased when an air lift or submersible pump is used for withdrawing liquid from a well. In such a situation the pressure near the outlet can be decreased to a small fraction of the hydrostatic head when there is no liquid flow. Pressure in a cavity is not necessarily uniform. When liquid is flowing pressure gradients are present as determined by liquid flow rate, permeability, density gradients and the like.

The presence of a stress arch over a subterranean cavity occurs since the area occupied by the cavity is largely incapable of supporting load of overburden. This can be compared with fracturing such as employed adjacent oil wells or for initiating a cavity such as involved in practice of this invention. During fracturing the hydraulic pressure in the formation is increased to the extent that overburden load is overcome. Since the hydraulic pressure supports the overburden, no stress arch develops. When pressure is relieved, the fractures close down on themselves or on an agent introduced to prop them open, such as sand, hence overburden remains supported and there is no development of a stress arch.

Spalling of formation particles into the cavity, particularly from the roof, can be promoted by increasing the hydraulic pressure of liquid in the cavity during a period of at least a few hours and even a few days. A period of at least about four hours is preferred.

A gradual increase in the hydraulic pressure in the cavity tends to lift the formation at the roof of the cavity and place the tension sagged formation below the pressure arch into compression. A time shorter than about two hours at increased hydraulic pressure may not provide adequate time for formation stresses to properly redistribute with the relatively low pressures involved in practice of this invention.

The minimum time for application of hydraulic pressure is the time required for a portion of the formation below the pressure arch to go from tension to compression or for at least a major relief of the tension in formation below the pressure arch. The length of time required to increase pressure in the cavity to the maximum is a function of the size of the cavity, the compressibility of the liquid in the cavity, the size and compressibility of any gas communicating with the cavity, increases in solution of gas in liquid as pressure increases, the rate of fluid injection and the quantity of formation subject to deformation and lifting of the roof of the cavity. A large cavity having an extensive roof span can require more time than a small cavity. Formation under a pressure arch can have multiple sag crevices which, in general are parallel to the roof of the cavity. The time and pressure applied can selectively lift or flex only lower portions of the formation below the stress arch, causing fragmentation of smaller units of formation than when higher pressures or longer times are involved. For example, the maximum hydraulic pressure applied can be sufficient for lifting only a portion of the roof of a cavity beneath a sag crevice beneath the pressure arch. This can induce greater fragmentation than may occur with massive fall of formation above the roof of the cavity.

A period of at least about two hours at pressures more than ¾ of the difference between the minimum pressure and maximum pressure is preferred. Thus, for example, in a situation where a full day is required to increase pressure from the minimum to the maximum, it is preferred to have a period of at least about two hours where the pressure has increased more than 75% of the total increase in pressure.

After the desired maximum pressure has been achieved, the hydraulic pressure is reduced towards the minimum and such a cycle of pressure increase and reduction is repeated for promoting spallation and gradually enlarging the cavity.

The hydraulic pressure in the subterranean cavity can be gradually increased by continually introducing solvent liquid into the cavity while withdrawing pregnant solution from the cavity in a quantity somewhat less than the quantity of solvent liquid introduced into the cavity. This can be done with a choke or throttle valve on the outlet pipe 14. The small amount of excess liquid in the cavity is accommodated by the slight compression of the liquid as hydraulic pressure increases, compression or solution of any trapped gas, intrusion of liquid into cracks and pores in the underground formation, and lifting of the roof of the cavity.

Thus, pressure can be gradually increased above the hydraulic head over a period of a few hours and even a few days for gradually changing the stress distribution in the underground formation. For example, pressure can be increased for four or five hours, or a cycle of about one day can be used. Alternatively, hydraulic pressure can be increased in a plurality of steps. If desired a rapid increase in pressure can be employed with a period of holding at about maximum pressure. The length of time is in part dependent on strength and related properties of the formation, and the thickness and length of the competent members underlying the stress arch.

When a desired maximum hydraulic pressure is achieved in the subterranean cavity it can be maintained for a time or pressure reduction can commence immediately. Preferably the pressure is at or near the maximum for at least about two hours if increased rapidly. Strain in subterranean formations changes gradually and it can be desirable to gradually increase pressure concomitantly.

After application of hydraulic pressure from the normal operating pressure in the order of the hydraulic head to the ground surface to a selected maximum pressure for at least about two hours, the pressure is reduced. Such increase and decrease is repeated for many cycles.

The pressure in the subterranean cavity can be suddenly reduced which tends to "drop" the roof of the cavity. This can be done, for example, by temporarily stopping introduction of solvent liquid into the cavity and opening the outlet pipe for discharging pregnant liquid from the cavity. Pressure can decrease to about the minimum pressure in a matter of minutes.

If desired, pressure can be reduced below a pressure corresponding to the hydrostatic head by reducing the height of the column of liquid between the cavity and the ground surface. This can be done by stopping introduction of solvent liquid and by use of a submersible pump, an air lift or the like, to reduce the effective height of the column of liquid in the well, thus reducing the hydraulic support on the roof of the cavity causing additional sagging and promoting spallation and collapse of formation from the roof. This can be more effective than merely reducing pressure to about the hydraulic head from the cavity to the ground surface since the magnitude of tension reapplied to the formation under the stress arch is increased, thereby promoting spallation and roof failure.

Alternatively, the hydraulic pressure in the cavity can be gradually decreased during a period of at least a few hours. This can be done by withdrawing a quantity of pregnant solution greater than the quantity of solvent liquid introduced during a period of a few hours. Cycling in this manner repeatedly flexes the roof of the cavity and "works" the subterranean formation, causing fatigue of formation leading to failure and spalling of formation particles in the cavity.

The maximum hydraulic pressure applied in the subterranean cavity depends at least in part on the geologic conditions. Under conditions where the loss of liquid into underground formation is not excessive, it can be desirable for the maximum hydraulic pressure to be sufficient to elastically lift the roof of the subterranean cavity. The maximum pressure is less than sufficient for lifting the overburden between the cavity and the top of the stress arch. Preferably the maximum pressure is less than the dilation pressure which is considered to be about 70% of the fracturing pressure.

This can avoid propagation of large fractures substantial distances from the subterranean cavity. By avoiding maximum pressures sufficient to cause extensive fracturing of the formation, excessive loss of liquid into fractures can be avoided. The maximum pressure to lift such overburden and/or cause fracturing depends on the apparent mean density of the overburden and the depth of the formation being leached. For example, in a shallow formation being leached at depths of less than 500 feet a pressure of 500 psi at the well head can be sufficiently high to fracture the formation, while in deep formations pressures of several thousand psi can be required.

To avoid fracturing and obtain the benefits of repeatedly cycling pressure, it is desirable that the maximum pressure at the roof of the cavity lie in the range of from about 1.6 to 2.7 times the hydraulic head between the cavity and the ground surface. If the pressure is less than about 1.6 times the head, the flexing of the formation may not be sufficient to cause extensive spalling of formation into the cavity. If the pressure is more than about 2.7 times the hydraulic head fracturing and/or damage to the geologic hydraulic seal adjacent the solution mining operation may occur.

The maximum hydraulic pressure applied is sufficient for lifting the material underlying the stress arch which has gone from its original state of compression to tension due to redistribution of stress over the cavity. The maximum hydraulic pressure is less than sufficient for lifting overburden above the stress arch. Preferably the maximum hydraulic pressure is sufficient to reverse the stresses and place material under the stress arch in compression. The minimum hydraulic pressure reestablishes tension in the material under the pressure arch. Repeated cycling of formation between tension and compression can contribute to spallation of the formation into the cavity, thereby enhancing permeability and exposing new mineral surfaces to leaching solution.

In some circumstances it can be quite desirable to suddenly decrease hydraulic pressure in the subterranean cavity since this can induce substantial differential pressures in the formation. Fluid filled pore spaces can have substantial "trapped" pressure which promotes small scale spalling or flaking.

FIG. 2 illustrates in generalized form a graph of hydraulic pressure in an underground cavity as a function of time. The time interval for each cycle can, for example, be in the order of a few hours to a few days.

The solid line 16 in FIG. 2 illustrates an application of this method in which hydraulic pressure in an underground cavity is gradually increased during a period of at least a few hours. Thereafter when a desired maximum hydraulic pressure has been achieved in the cavity the pressure is gradually reduced during a period of at least about two hours. Although illustrated with approximately similar time intervals for increasing and decreasing pressure, it will be understood that the length of these intervals can differ. When the hydraulic pressure decreases to a minimum in the order of the hydraulic head between the cavity and the ground surface, the pressure is again gradually increased.

The dashed line 17 in FIG. 2 illustrates another embodiment of practice of this invention. In this technique hydraulic pressure in the cavity is increased from a minimum of about the hydraulic head in the well bore communicating with the cavity or less, to a selected maximum pressure which is then held during a period of at least about two hours. The pressure in the cavity is then suddenly reduced to about the minimum pressure and the cycle repeated for flexing underground formation adjacent the cavity. By "suddenly" reducing pressure it is meant that pressure is relieved at the wellhead about as rapidly as feasible under the circumstances, taking into consideration the quantity of, and type of, fluid released, safety and undesired side effects such as entrainment of excessive solids in liquid in the well.

The dotted line 18 in FIG. 2 illustrates another application of this process. In this embodiment the hydraulic pressure in the underground cavity is gradually increased during a period of at least a few hours to a maximum pressure. When the desired maximum pressure is achieved, the pressure is suddenly decreased to a minimum of about the hydrostatic head between the cavity and the ground surface or less. Many other exemplary pressure cycles will be apparent. For example, the pressure can be decreased to about the minimum and held for a few hours before again increasing.

Although not intended to be bound by any theory it is believed that reasons are understood for promotion of spallation of formation from walls and roof of an underground cavity by such pressure cycling. The increase in the hydraulic pressure tends to open fissures and cracks in the formation and force liquid into such openings. Closed pore spaces in the formation adjacent the cavity can be at low pressure and differential pressures can essentially cause these pores to implode. Although hydraulic pressure is considered to act uniformly in all directions, inhomogeneities in the formation can result in non-uniform distribution of stress and spalling or sloughing of formation into the cavity.

This is particularly probable in an embodiment where hydraulic pressure in the cavity is suddenly decreased. Increased pressure in pore spaces and crevices in the formation may not have time to equilibrate and substantial differential stresses can be established in the formation, causing either large or small particles to spall from the formation.

The force required to break down the formation must overcome lithostatic pressures and the bonding strength of the formation. It is believed the cyclic "working" of the formation by repeatedly increasing and decreasing hydraulic pressure gradually diminishes the bonding strength of the formation. Lithostatic forces can also be altered by application of hydraulic pressure.

Such effects can be considerably enhanced by cyclic application of hydraulic pressure of a liquid which can act as a solvent for constituents of the formation. Increasing pressure of such solvent liquid can force liquid into pores and fissures in some types of formation for chemical attack on constituents of the formation. Reduction of the hydraulic pressure can tend to close such pores and fissures thereby ejecting liquid. By increasing hydraulic pressure during a period of at least a few hours, this permits time for liquid to be conveyed through small openings in the formation and for solution reactions to occur in tight pores and fissures.

Cyclically repeating the increases and decreases in pressure continually exposes formation adjacent such fissures and pores to fresh solvent. Absent such cycling, the liquid in pore spaces and fissures can become spent due to consumption of solvent and/or concentration of solute and substantially ineffective for further leaching. The enhanced leaching of constituents of the formation can substantially weaken formation on the walls and roof of the cavity and promote spallation.

The effect of cyclic pressure variations can be particularly useful where the leaching reactions tend to produce gaseous products. Increasing hydraulic pressure can contract bubbles of such gaseous products by compressing the gas and/or by enhancing solution of the gas in the liquid. This can remove gaseous products of reaction from pores, fissures and surface areas of the formation and enhance reaction rates.

Gradual increase and decrease of pressure in the cavity can cycle the formation under the pressure arch between tension and compression and large blocks of gangue can be broken into the cavity for exposing leachable minerals.

FIG. 3 illustrates in semi-schematic vertical cross section another embodiment of underground cavity suitable for practice of this invention. As illustrated in this embodiment two bore holes or wells 21 and 22 are drilled from the ground surface 23 to a subterranean region suitable for in situ leaching or solution mining. Although only two wells are illustrated, it will be clear that a plurality of wells in various arrays of inlet and outlet wells can be provided. For example, parallel rows of inlet wells and outlet wells can be used or a five-spot or quincunx pattern can be used with four inlet wells spaced around one outlet well. A variety of such patterns like those used in petroleum wells can be suitable, or special patterns of wells adapted to the geologic structure can be employed.

Communication through the underground formation is established between such wells. Such communication can be provided by inherent permeability or fissures in the formation, or can be induced by artificial means such as hydraulic fracturing or the like. Hydraulic fracturing of the formation as employed adjacent to oil wells or for coalescence of salt wells can be suitable for increasing permeability of many types of formation for in situ leaching. For example, fractures in the formation can be introduced or extended by application of sufficient hydraulic pressure in one or both wells to propagate a fracture between the wells. In many formations, propping agents such as sand, beads or the like, can be introduced in such fractures for holding the fractures.

When fluid communication between the wells 21 and 22 has been established, a leaching solution comprising a solvent for constituents of the formation can be introduced through one of the wells 22. The solvent liquid is transported towards the other well 21 through the underground connection between the wells. Pregnant solution is withdrawn by way of the other well 21. Generally, the inlet well 22 is located up-dip from the outlet well 21 so that denser pregnant solution can tend to migrate downwardly in the formation towards the outlet well. Flow of such leaching solution between the wells tends to enlarge fractures and/or enhance inherent permeability of the formation, thereby gradually forming an underground cavity 24. Such a cavity can be formed between a plurality of input wells and/or a plurality of output wells. Once formed such a cavity can be enlarged by repeated application of hydraulic pressure as hereinabove described.

An embodiment having a plurality of wells in fluid communication with each other can often be better adapted for practice of this invention than an embodiment having a single well with a cavity adjacent the well. In a multiple well system a principal portion of the leaching action and formation of a cavity tends to occur near inlet wells. When hydraulic pressure is increased, flexing and fragmentation of subterranean formation adjacent a cavity can damage a well bore and/or casing in the well. In a single well embodiment, damage can occur to tubing for withdrawing pregnant solution from the cavity and special steps may be required to protect such tubing. In a multiple well system such damage is less of a problem adjacent an inlet well than it could be adjacent an outlet well, particularly when a submersible pump or air lift device is employed in the outlet well. Such damage can occur adjacent a lower portion of an inlet well and that lower portion and any casing in the well can be regarded as expendable.

Rapid application of hydraulic pressure pulses can also promote spallation of formation particles. Rapid pulsing of hydraulic pressure at a wellhead has been proposed. It has also been proposed to detonate explosive charges in a well for applying rapid pressure pulses to underground formation.

In practice of this invention such rapid pressure pulses can be applied to an underground formation by means of special explosive charges known as cavity charges or shaped charges. A shaped charge is a body of explosive in the general form of a hollow cone. A generally cup-shaped explosive charge can also be suitable. When such a shaped charge of explosive is detonated, a principal portion of the explosive force is directed along the axis of the cavity in the charge.

A cavity charge or shaped charge of explosive is placed in a bore hole communicating with the subterranean cavity so that the axis of the cavity in the charge is aligned with the axis of the bore hole. Detonation of the explosive charge generates a pressure pulse in the liquid in the underground cavity and hence against the surrounding formation. Application of such pressure pulses to the surrounding formation can induce hydraulic pressure concentrations or pressure waves whose distribution may be non-uniform causing spallation of particles from the formation into the cavity. The rapid pressure pulse from an explosive charge can be likened to a "fluid wedge" driven into a crevice for inducing spallation of particles into the cavity.

Since the axis of the cavity in the explosive charge is aligned with the axis of the bore hole, a principal portion of the explosive force of the shaped charge is directed along the axis of the bore hole, thereby minimizing any potential for damage to the bore hole or casing.

Larger explosive charges can be used by practice of this technique than can be provided by conventional sticks of dynamite or the like. A plurality of such explosive charges can be lowered through a bore hole for applying a series of rapid pressure pulses to the liquid in the cavity. Preferably, a plurality of such charges are detonated with short time delays between successive detonations.

A modification of the technique for enlarging a subterranean cavity can be required for an argillaceous formation. In such a formation lithostatic pressure can cause collapse of artificially induced fractures and squeezing of argillaceous insolubles into small fissures and micro-fractures in the rock. Solution channels that have been established can thereby be blocked. The use of sand or the like for propping open fractures in such argillaceous formation may not be satisfactory since artificially induced fractures can close on themselves embedding the propping agent into the formation.

In such a formation inlet and outlet wells are formed to the portion of the formation to be leached. A fracture is induced by elevated hydraulic pressure near the bottom of the zone containing sought after mineral values for establishing communication between the inlet and outlet wells. Formation can be fractured at a selected elevation by means of a straddle packer in one or both of the wells. A sufficient pressure is then maintained in the formation to prop the fractures open and a solvent liquid is circulated through such fractures until such time as the solvent has dissolved a self-supporting channel between the wells. Cycling of hydraulic pressure as hereinabove described can then be practiced for enlarging such a subterranean cavity.

Maintenance of a continual pressure in the formation to prevent closure of artificially induced fractures has distinct advantages. By preventing collapse insoluble argillaceous material is kept separate from the intact formation so that the soluble mineral values can be contacted by solvent. In such an embodiment it can be desirable to inject solvent so as to maintain at least the dilation pressure in the formation; that is, at least 70% of the fracturing pressure, thereby assuring that the artificially induced fractures do not close. Cycles of hydraulic pressure can be superimposed on such a minimum pressure for inducing spallation of formation into such a cavity.

In some argillaceous formations the clays do not swell in the presence of fresh water, however, many formations contain argillaceous material that will swell in fresh water. Such swelling can tend to close solution channels and restrict flow of solvent and pregnant liquid. Swelling of such argillaceous material can be inhibited by buffering the liquid used for fracturing and/or the solvent. Inclusion of ionic salts including cations selected from the group consisting of sodium, potassium, calcium, magnesium and ammonium, in the fracturing liquid and/or solvent can provide such buffering action against swelling of clay. These cations apparently inhibit hydration of the clay minerals and thereby prevent swelling. Use of such materials for stabilization of soils containing clay is known. An economical and satisfactory salt is sodium chloride. Brine can be used for the fracturing liquid and sodium chloride can be included in the solvent liquid used for enlarging fractures and leaching formations to obtain desired mineral constituents. A variety of other agents for preventing swelling of the clay in the argillaceous formation will be apparent.

Although only a few embodiments of a method for enlarging an underground cavity have been described herein many modifications and variations will be apparent to one skilled in the art. Thus, for example, the maximum pressure for most cycles can be less than sufficient for lifting the overburden between the cavity and the ground surface, and then occasionally a maximum pressure is achieved sufficient for lifting such overburden and thereby initiating additional fractures. If desired, high pressure liquid withdrawn from one cavity during reduction of pressure can be introduced into another cavity during increase of pressure for conserving the stored energy. Many other modifications and variations will be apparent to one skilled in the art and it is therefore to be understood that this invention is not limited, except as set forth in the following claims.

What is claimed is:

1. A method for enhancing exposure of leachable mineral values adjacent a solution mining cavity having a substantially unsupported roof in a subterranean formation comprising the steps of:

substantially filling such a subterranean cavity with a liquid; and repeatedly increasing hydraulic pressure of the liquid in the subterranean cavity from a minimum pressure of about the hydraulic head between the subterranean cavity and the ground surface or less, to a maximum pressure sufficient to lift the roof of the cavity and less than sufficient for lifting the overburden above the top of the stress arch which forms over the subterranean cavity, and then decreasing hydraulic pressure to such minimum pressure, the time interval of increasing hydraulic pressure to the maximum pressure being at least about two hours.

2. A method as recited in claim 1 wherein hydraulic pressure in the subterranean cavity is suddenly decreased from about the maximum pressure to about the minimum pressure.

3. A method as recited in claim 1 wherein the hydraulic pressure in the subterranean cavity is gradually decreased from about the maximum pressure to about the minimum pressure during a period of at least about two hours.

4. A method as recited in claim 1 wherein the liquid comprises a solvent for a mineral constituent of the subterranean formation.

5. A method as recited in claim 4 comprising continually introducing a liquid comprising a solvent and withdrawing a pregnant solution containing dissolved mineral constituents from the subterranean cavity.

6. A method as recited in claim 1 wherein the maximum hydraulic pressure is in the order of about 1.6 to 2.7 times the hydraulic head between the subterranean cavity and the ground surface.

7. A method as recited in claim 1 wherein the minimum pressure is less than the hydrostatic head between the cavity and the ground surface.

8. A method as recited in claim 1 practiced in a formation containing clay further comprising the preliminary steps of:

fracturing such formation for establishing fluid communication between an inlet well and an outlet well;

maintaining sufficient hydraulic pressure in such formation for propping open fractures; and circulating solvent liquid through such fractures for dissolving mineral constituents of the formation.

9. A method as recited in claim 1 practiced in a formation containing swellable clay comprising including sufficient ionic salt in such liquid for inhibiting swelling of the clay.

10. A method as recited in claim 9 wherein the ionic salt comprises sodium chloride.

11. A method for promoting fragmentation adjacent a subterranean cavity having a substantially unsupported roof in a subterranean formation, and including a stress arch over the cavity transferring load from overburden above the cavity to locations spaced laterally from the cavity, comprising the steps of:

substantially filling such a cavity with a liquid; and repeatedly cycling hydraulic pressure of liquid in the subterranean cavity between a minimum pressure and a maximum pressure sufficient to reverse stress in formation underlying the stress arch over the cavity from tension to compression and less than sufficient for lifting overburden between the top of the stress arch and the ground surface.

12. A method as recited in claim 11 wherein the hydraulic pressure in the subterranean cavity is increased from the minimum pressure to the maximum pressure for a period of at least about two hours.

13. A method as recited in claim 11 wherein the hydraulic pressure in the subterranean cavity is gradually decreased from about the maximum pressure to about the minimum pressure during a period of at least about two hours.

14. A method as recited in claim 11 wherein hydraulic pressure in the subterranean cavity is suddenly decreased from about the maximum pressure to about the minimum pressure.

15. A method as recited in claim 11 wherein the minimum pressure is less than the hydrostatic head between the cavity and the ground surface.

16. A method as recited in claim 11 wherein the liquid comprises a solvent for a mineral constituent of the subterranean formation.

17. A method as recited in claim 16 comprising continually introducing a liquid comprising a solvent and withdrawing a pregnant solution containing dissolved mineral constituents from the subterranean cavity.

18. A method as recited in claim 17 further comprising the step of withdrawing liquid from a portion of a well between the cavity and the ground surface for reducing hydraulic head above the cavity.

19. A method as recited in claim 11 practiced in a formation containing clay further comprising the preliminary steps of:

fracturing such formation for establishing fluid communication between an inlet well and an outlet well;

maintaining sufficient hydraulic pressure in such formation for propping open fractures; and circulating solvent liquid through such fractures for dissolving mineral constituents of the formation.

20. A method for enlarging a cavity having a substantially unsupported roof in a subterranean formation comprising the steps of:

substantially filling the subterranean cavity with liquid;

increasing hydraulic pressure in the subterranean cavity during a period of at least about two hours, the maximum hydraulic pressure in the subterranean cavity being less than sufficient for lifting overburden above the top of a stress arch over the subterranean cavity;

decreasing hydraulic pressure in the subterranean cavity during a subsequent period of at least about two hours; and alternately repeating the increasing and decreasing steps for cyclic flexing of the roof of the subterranean cavity.

21. A method as recited in claim 20 wherein the minimum pressure is less than the hydrostatic head between the cavity and the ground surface.

22. A method as recited in claim 20 wherein hydraulic pressure is gradually increased during a period of at least about two hours from a minimum pressure of about the hydraulic head between the subterranean cavity and the ground surface to a selected maximum pressure.

23. A method as recited in claim 20 practiced in a formation containing clay further comprising the preliminary steps of:

fracturing such formation for establishing fluid communication between an inlet well and an outlet well;

maintaining sufficient hydraulic pressure in such formation for propping open fractures; and circulating solvent liquid through such fractures for dissolving mineral constituents of the formation.

24. A method as recited in claim 20 practiced in a formation containing swellable clay comprising including sufficient ionic salt in such liquid for inhibiting swelling of the clay.

25. A method as recited in claim 24 wherein the ionic salt comprises sodium chloride.

26. A method as recited in claim 20 wherein the liquid comprises a solvent for a mineral constituent of the subterranean formation.

27. A method for enlarging a subterranean cavity having a substantially unsupported roof in a subterranean formation and for exposing a leachable mineral constituent of the subterranean formation comprising the steps of:

substantially filling the subterranean cavity with a liquid;

increasing hydraulic pressure in the subterranean cavity during the period of at least about two hours, the maximum hydraulic pressure in the subterranean cavity being less than sufficient for lifting overburden above the top of a stress arch over the subterranean cavity; and thereafter suddenly decreasing the hydraulic pressure in the subterranean cavity.

28. A method as recited in claim 27 wherein the maximum hydraulic pressure in the cavity is about 1.6 to 2.7 times the hydraulic head between the subterranean cavity and the ground surface.

29. A method as recited in claim 27 wherein the minimum pressure is less than the hydrostatic head between the cavity and the ground surface.

30. A method as recited in claim 27 practiced in a formation containing clay further comprising the preliminary steps of:

fracturing such formation for establishing fluid communication between an inlet well and an outlet well;

maintaining sufficient hydraulic pressure in such formation for propping open fractures; and circulating solvent liquid through such fractures for dissolving mineral constituents of the formation.

31. A method as recited in claim 27 wherein the liquid comprises a solvent for a mineral constituent of the subterranean formation.

32. A method as recited in claim 31 comprising continually introducing a liquid comprising a solvent and withdrawing a pregnant solution containing dissolved mineral constituents from the subterranean cavity.

33. A method as recited in claim 32 further comprising the step of withdrawing liquid from a portion of a well between the cavity and the ground surface for reducing hydraulic head above the cavity.

34. A method for in situ leaching of at least one mineral constituent in a subterranean formation comprising the steps of:

drilling at least one well from the ground surface to a subterranean formation selected for leaching;

forming a cavity in the subterranean formation adjacent such a well;

substantially filling the subterranean cavity with a solvent liquid for leaching mineral constituents of the subterranean formation;

withdrawing a pregnant solution containing at least one dissolved mineral constituent from the subterranean cavity;

repeatedly cyling hydraulic pressure of liquid in the subterranean cavity between a minimum pressure and a maximum pressure less than sufficient for lifting the overburden between the subterranean cavity and the ground surface, for promoting spallation of formation particles and enlarging the subterranean cavity; and withdrawing at least a portion of such formation particles with the pregnant solution.

35. A method as recited in claim 34 further comprising the step of withdrawing liquid from a portion of such a well between the cavity and the ground surface for reducing hydraulic head above the cavity.

36. A method as recited in claim 34 wherein the hydraulic pressure in the subterranean cavity is gradually increased from about the minimum pressure to about the maximum pressure during a period of at least about two hours.

37. A method as recited in claim 34 wherein hydraulic pressure in the subterranean cavity is suddenly decreased from about the maximum pressure to about the minimum pressure.

38. A method as recited in claim 34 wherein the hydraulic pressure in the subterranean cavity is gradually decreased from about the maximum pressure to the minimum pressure during a period of at least about two hours.

39. A method as recited in claim 34 practiced in a formation containing swellable clay comprising including sufficient ionic salt in such liquid for inhibiting swelling of the clay.

40. A method as recited in claim 39 wherein the ionic salt comprises sodium chloride.

41. A method as recited in claim 34 wherein hydraulic pressure in the subterranean cavity is gradually increased by introducing a quantity of solvent liquid into the subterranean cavity during a period of at least about two hours which is greater than the quantity of pregnant solution withdrawn from the cavity during such period.

42. A method as recited in claim 41 wherein the quantity of pregnant solution withdrawn from the subterranean cavity during a period of at least about two hours is greater than the quantity of solvent liquid introduced during such period for gradually reducing hydraulic pressure in the subterranean cavity.

43. A method as recited in claim 41 wherein the hydraulic pressure in the subterranean cavity is reduced suddenly.

44. A method for in situ leaching of mineral constituents from a subterranean formation comprising the steps of:

drilling at least one well from the ground surface to a subterranean formation to be leached;

forming an initial cavity in the subterranean formation in communication with such a well;

substantially filling the initial subterranean cavity with a solvent liquid for dissolving mineral constituents from the subterranean formation;

withdrawing a pregnant solution containing dissolved mineral constituents from the subterranean cavity;

increasing hydraulic pressure in the subterranean cavity during a period of at least about two hours wherein the maximum hydraulic pressure in the subterranean cavity is less than sufficient for lifting overburden above the top of the stress arch formed over the cavity; and thereafter decreasing hydraulic pressure in the subterranean cavity for promoting spallation of formation particles into the cavity; and withdrawing at least a portion of such formation particles from the subterranean cavity.

45. A method as recited in claim 44 wherein hydraulic pressure in the subterranean cavity is gradually increased during a period of at least about two hours from a minimum pressure of about the hydraulic head between the subterranean cavity and the ground surface, and a selected maximum pressure.

46. A method as recited in claim 45 wherein the hydraulic pressure in the subterranean cavity is suddenly decreased from about the maximum pressure to about the minimum pressure.

47. A method as recited in claim 45 wherein the hydraulic pressure in the subterranean cavity is gradually decreased from about the maximum pressure to about the minimum pressure during a period of at least about two hours.

48. A method as recited in claim 43 wherein hydraulic pressure in the subterranean cavity is gradually increased during a period of at least about two hours from a minimum pressure less than the hydraulic head between the subterranean cavity and the ground surface, and a selected maximum pressure.

* * * * *

UNITED STATES PATENT AND TRADEMARK OFFICE

CERTIFICATE OF CORRECTION

PATENT NO. : 4,398,769

DATED : August 16, 1983

INVENTOR(S) : Charles H. Jacoby

It is certified that error appears in the above-identified patent and that said Letters Patent is hereby corrected as shown below:

In column 2, line 43 "leaving" should read -- leaching --.

In column 16, line 54, "43" should read -- 44 -- .

Signed and Sealed this

*Thirteenth* Day of *December 1983*

[SEAL]

*Attest:*

GERALD J. MOSSINGHOFF

*Attesting Officer*

*Commissioner of Patents and Trademarks*